US010330096B1

(12) United States Patent
Blake et al.

(10) Patent No.: US 10,330,096 B1
(45) Date of Patent: Jun. 25, 2019

(54) SYSTEM AND METHOD FOR COLD TEMPERATURE CONTROL OF AN ELECTRIC OIL PUMP

(71) Applicant: Polaris Industries Inc., Medina, MN (US)

(72) Inventors: Dallas J. Blake, Roseau, MN (US); James H. Buchwitz, Strathcona, MN (US)

(73) Assignee: Polaris Industries Inc., Medina, MN (US)

( * ) Notice: Subject to any disclaimer, the term of this patent is extended or adjusted under 35 U.S.C. 154(b) by 809 days.

(21) Appl. No.: 14/190,933

(22) Filed: Feb. 26, 2014

Related U.S. Application Data

(60) Provisional application No. 61/773,361, filed on Mar. 6, 2013.

(51) Int. Cl.

| | |
|---|---|
| ***F01M 1/02*** | (2006.01) |
| ***F01M 1/16*** | (2006.01) |
| ***F04B 49/06*** | (2006.01) |
| ***F04B 49/20*** | (2006.01) |

(52) U.S. Cl.
CPC ..... *F04B 49/20* (2013.01); *F01M 1/16* (2013.01); *F04B 49/06* (2013.01); *F01M 2001/0223* (2013.01); *F01M 2250/64* (2013.01); *F04B 2205/09* (2013.01)

(58) Field of Classification Search
CPC ..... F04B 49/02; F04B 49/06; F04B 49/20; F04B 49/022; F04B 2205/09; F01M 1/16; F01M 2001/0223; F01M 2250/64; F02B 2039/16; F02B 2039/162; F02B 2039/164; F16N 7/38
USPC ..... 184/26
See application file for complete search history.

(56) References Cited

U.S. PATENT DOCUMENTS

| | | | | |
|---|---|---|---|---|
| 6,422,183 | B1 * | 7/2002 | Kato | F01M 3/02 123/73 AD |
| 6,904,879 | B2 * | 6/2005 | Kato | F01M 1/02 123/73 AD |
| 7,028,659 | B2 * | 4/2006 | Schneider | F01M 1/02 123/196 R |
| 8,459,392 | B2 | 6/2013 | Bernier et al. | |
| 9,168,913 | B2 * | 10/2015 | Lee | B60W 10/06 |
| 2010/0163327 | A1 * | 7/2010 | Bernier | B62M 27/02 180/190 |
| 2015/0152757 | A1 * | 6/2015 | Barber | F01M 1/02 123/304 |

* cited by examiner

*Primary Examiner* — Nathan C Zollinger
(74) *Attorney, Agent, or Firm* — Faegre Baker Daniels LLP

(57) ABSTRACT

An apparatus and method for controlling an electric oil pump with a pump control signal generated by an electronic control unit (ECU) of a vehicle. The pump control signal has a variable drive time portion during which the electric oil pump is actuated to supply oil to an engine of the vehicle and a variable cycle time defining a frequency of the pump control signal.

28 Claims, 5 Drawing Sheets

SYSTEM AND METHOD FOR COLD TEMPERATURE CONTROL OF AN ELECTRIC OIL PUMP

CROSS REFERENCE TO RELATED APPLICATION

This application claims the benefit of U.S. Application Ser. No. 61/773,361, filed on Mar. 6, 2013, the disclosure of which is expressly incorporated herein by reference.

BACKGROUND AND SUMMARY OF THE DISCLOSURE

The present disclosure relates to a system and method for lubricating an engine of a vehicle. More particularly, the present disclosure relates to a system and method for controlling operation of an electronic oil pump to provide improved lubrication of the engine, particularly during cold temperature conditions.

The lubrication system and method in the present disclosure is particularly suited for use with cold weather vehicles such as snowmobiles, but may also be used in other types of vehicles. In conventional lubrication systems, a lubricant such as oil is stored in an oil tank. The oil tank may be integral with or separate from the engine. An oil pump has an input coupled to an output of the oil tank.

Conventional mechanical oil pumps are driven by the engine. In contrast, electric oil pumps are controlled by a signal from an electronic control unit (ECU). In two stroke engines, the oil pump provides oil which is mixed with fuel and burned in the engine. Therefore, it is important for the oil pump to deliver a proper volume of oil to a two stroke engine to maintain the fuel/oil ratio at a desired level.

Vehicles such as snowmobiles are often operated at very cold temperatures. At such low temperatures, the viscosity of the oil in the oil tank and oil pump increases to a high viscosity level. Such high viscosity oil is difficult to pump, especially during initial start up of a cold engine. Both mechanical oil pumps and electric oil pumps are subject to low volumetric flow rates at cold oil temperatures with high oil viscosity. However, unlike a mechanical oil pump which is physically mounted to an engine, an electric oil pump is often remotely mounted on the vehicle. Such remote mounted electric oil pumps are not subject to much pump heating as the engine temperature increases. As such, the electric oil pump control strategy of the present disclosure controls or manipulates an oil pump command signal from the ECU to increase volumetric efficiency of the oil pump such that oil delivery from the oil pump meets the fuel/oil ratio requirements of the engine.

After a cold soak to low ambient temperatures, an electric oil pump volumetric output is lower for the first few oil pump actuations or "shots". Therefore, the system and method of oil pump output conditioning of the present disclosure eliminates the first few ineffective oil pump shots from an oil volume output calculation so that oil pump efficiency is more stable. This method, used in conjunction with control signal manipulation discussed below, increases oil pump volumetric efficiency without causing an over-oiling condition.

The system and method of the present disclosure manipulates an oil pump command signal drive time such that the drive time is increased with decreasing temperature to increase pump volumetric efficiency of the oil pump. The drive time correction uses both a representative temperature measurement as well as the pump drive frequency which are represented by inlet air temperature and engine speed, respectively. For example, the oil pump characteristic volume is manipulated to account for a reduction in volumetric efficiency of the oil pump at low temperatures even with the increased signal drive time. This allows greater versatility in both low and high frequency pump operation with oils of varying density and kinematic viscosity.

In an illustrated embodiment of the present disclosure, a method is provided for controlling an electric oil pump with a pump control signal generated by an electronic control unit (ECU) of a vehicle. The pump control signal has a variable drive time portion during which the electric oil pump is actuated to supply oil to an engine of the vehicle and a variable cycle time defining a frequency of the pump control signal. The illustrated method includes determining a base pump volume of the electric oil pump; determining a temperature associated with the engine; and correcting the base pump volume using the determined temperature to provide a corrected pump volume. The method also includes determining a speed of the engine; determining a frequency of the pump control signal based on the determined engine speed and the corrected pump volume; determining a drive time of the pump control signal based on the determined engine speed and the determined temperature; and controlling the electric oil pump using a pump control signal having the determined drive time and the determined frequency.

In another illustrated embodiment of the present disclosure, a method is provided of controlling an electric oil pump with a pump control signal generated by an electronic control unit (ECU) of a vehicle. The pump control signal has a variable drive time portion during which the electric oil pump is actuated to supply oil to an engine of the vehicle and a variable cycle time defining a frequency of the pump control signal. The illustrated method includes determining a speed of the engine; determining a volume of oil to deliver from the electric oil pump to the engine based on the determined engine speed; and determining a temperature associated with the engine. The method also includes determining a number of initial ineffective oil pump actuations after start up of the engine due to a high oil viscosity based on the determined temperature; ignoring the determined number of initial ineffective oil pump actuations when determining the volume of oil delivered from the electric oil pump to the engine; determining a frequency of the pump control signal and a drive time of the pump control signal based on the determined temperature and determined engine speed to deliver the determined volume of oil from the electric oil pump to the engine; and controlling the electric oil pump using a pump control signal having the determined drive time and the determined frequency.

Additional features of the present disclosure will become apparent to those skilled in the art upon consideration of the following detailed description of illustrative embodiments exemplifying the best mode of carrying out the invention as presently perceived.

BRIEF DESCRIPTION OF THE DRAWINGS

The foregoing aspects and additional features of the present system and method will become more readily appreciated and become better understood by reference to the following detailed description when taken in conjunction with the accompanying drawings.

Figure 1:
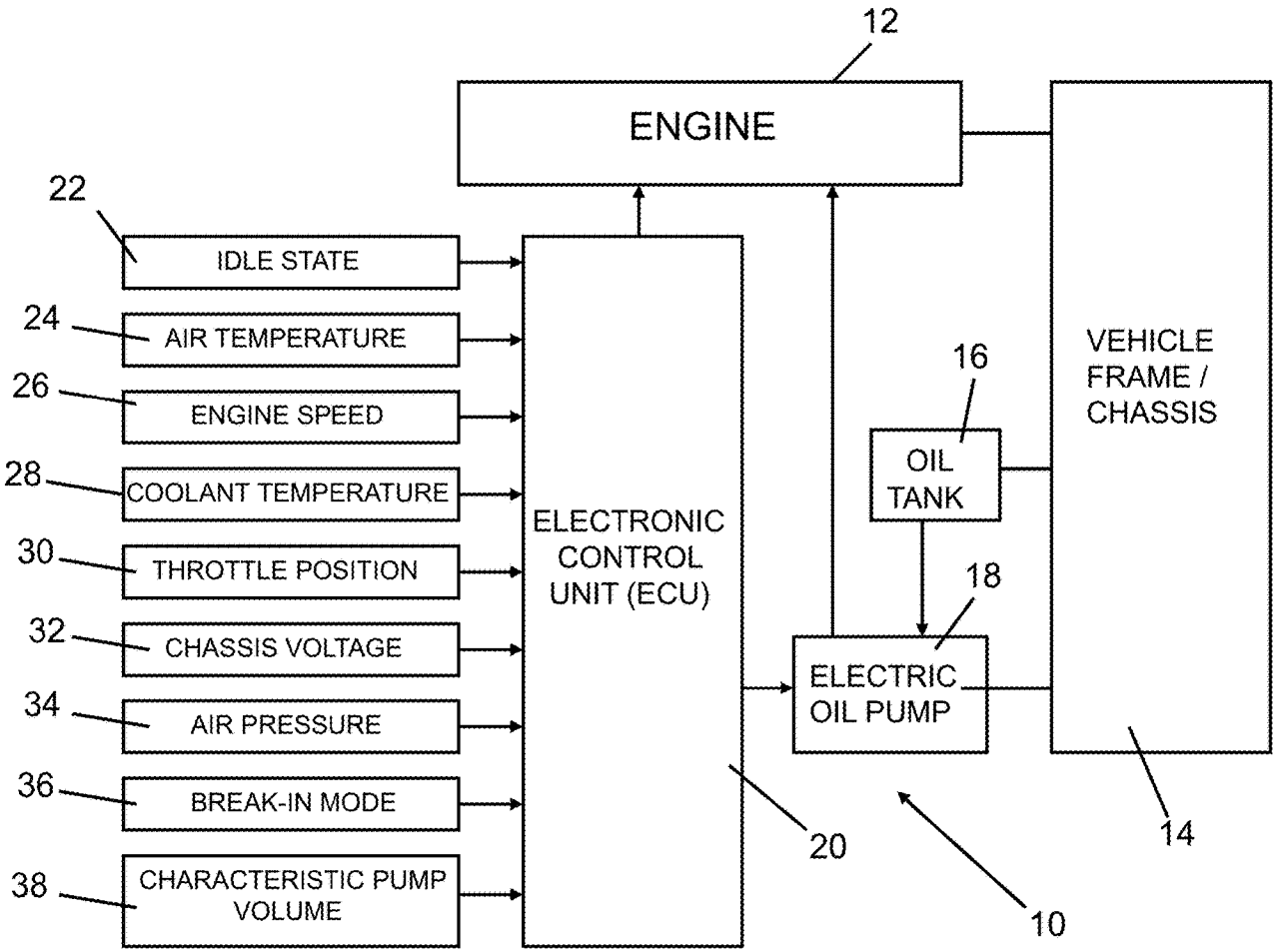
FIG. 1 is a block diagram illustrating a lubrication system for an engine of a vehicle in accordance with the present disclosure.

Although the drawings represent embodiments of various features and components according to the present disclosure, the drawings are not necessarily to scale and certain features may be exaggerated in order to better illustrate and explain the present disclosure.

DETAILED DESCRIPTION OF THE DRAWINGS

For the purposes of promoting an understanding of the principles of the present disclosure, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It is understood that no limitation of the scope of the invention is thereby intended. The present invention includes any alterations and further modifications in the illustrated devices and described methods and further applications of the principles of the invention which would normally occur to one skilled in the art to which the invention relates.

Referring more to the drawings, FIG. 1 illustrates a lubrication system 10 of the present disclosure for providing lubrication to an engine 12 of a vehicle. Illustratively, the engine 12 is mounted to a vehicle chassis or frame 14. In the illustrated embodiment, an oil tank 16 is coupled to the frame 14 spaced apart from the engine 12. An electric oil pump 18 is also coupled to a frame spaced apart from the oil tank 16. Oil pump 18 is illustratively controlled by an electronic control unit (ECU) 20. ECU 20 also provides output controls for engine 12 in a conventional manner.

ECU 20 is coupled to outputs from a plurality of different sensors including, but not limited to, an idle state sensor 22, an air temperature sensor 24, an engine speed sensor 26, a coolant temperature sensor 28 and a throttle position sensor 30. ECU 20 is also coupled to outputs from a chassis voltage sensor 32 and an air pressure sensor 34. The ECU 20 also receives inputs to determine whether the engine is in a break-in mode 36 and to determine a characteristic pump volume 38 of the oil pump 18.

Electric oil pumps 18 used in vehicles such as snowmobiles typically allow for increased packaging capability compared to a crankshaft driven mechanical oil pumps. However, because oil pump 18 is mounted remotely from oil tank 16 and engine 12, the oil pump 18 is not subject to much heating as the temperature of the engine 12 increases. The system and method of the present disclosure provides cold temperature correction for the electric oil pump 18 control from ECU 20 to promote high viscosity oil flow within the operating conditions of the engine to reduce the likelihood of cold temperature piston scuffing. In other words, the control strategy of the present disclosure controls the oil pump command signal from ECU 20 to increase volumetric efficiency of the oil pump 18 with the high oil viscosity caused by cold temperatures.

Oil pump 18 pumps oil to the engine 12 in a conventional manner. Oil pump receives oil from an outlet of oil tank 16. In two stroke engines, oil pump 18 pumps oil to engine 12 which is mixed with fuel and burned in the engine 12. Therefore, oil is not recirculated back to oil tank 16 in two stroke engines.

Figure 2:
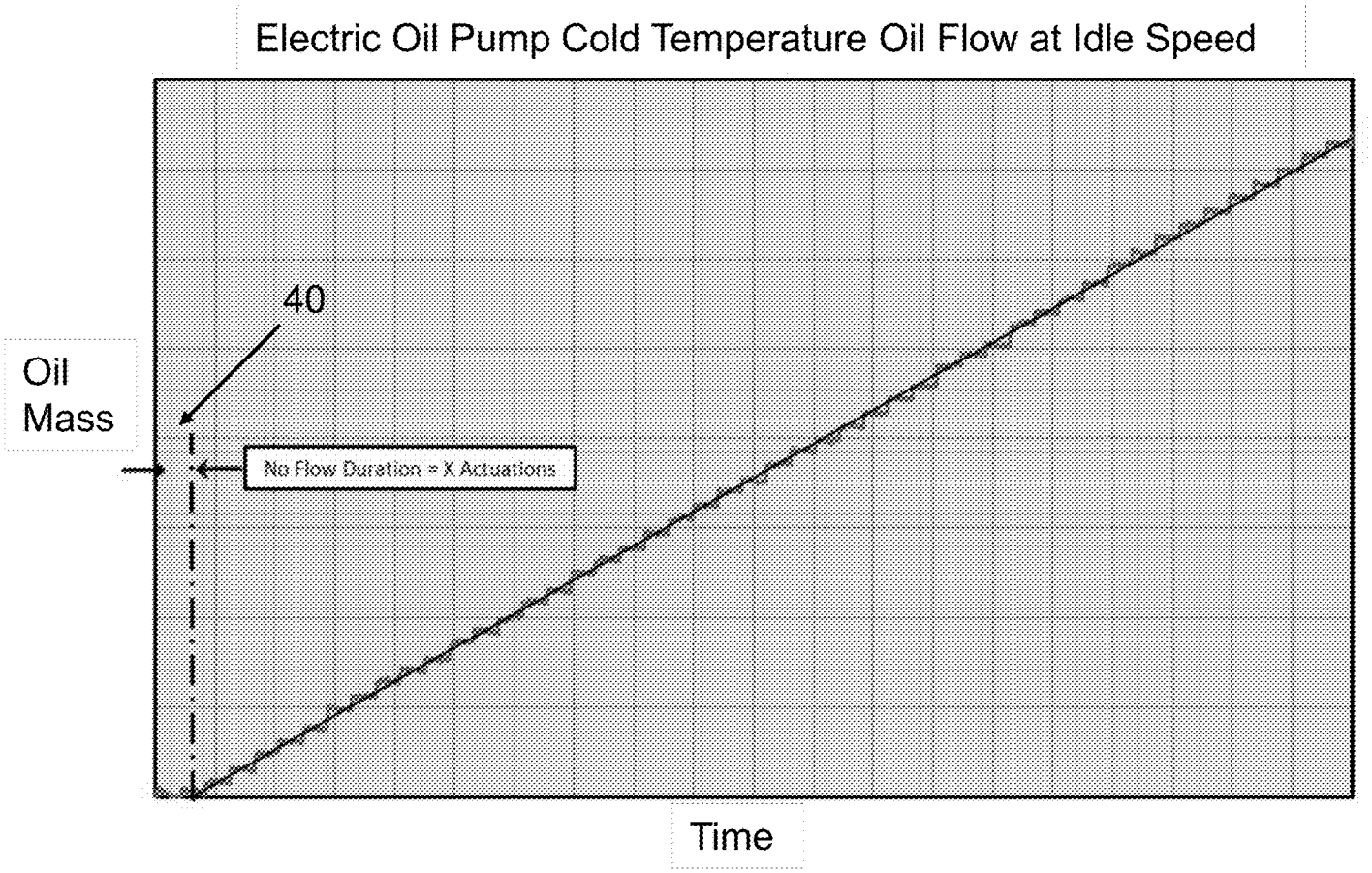
FIG. 2 is a graph showing an oil mass output from electric oil pump measured during cold temperature at engine idle.

As discussed above, during cold ambient temperatures, the initial actuations of the electric oil pump produce a reduced amount of oil mass flow upon initial start up of the engine 12. FIG. 2 illustrates an example of the oil mass flow from oil pump 18 at cold temperatures. During the first initial actuations or "shots" of the oil pump 18, little or no oil flow occurs from the oil pump 18 as shown at location 40 in FIG. 2. The duration of the "no flow" period 40 varies depending upon the type of oil used, the ambient temperature, and the operating specifications of the particular oil pump 18.

Figure 3:
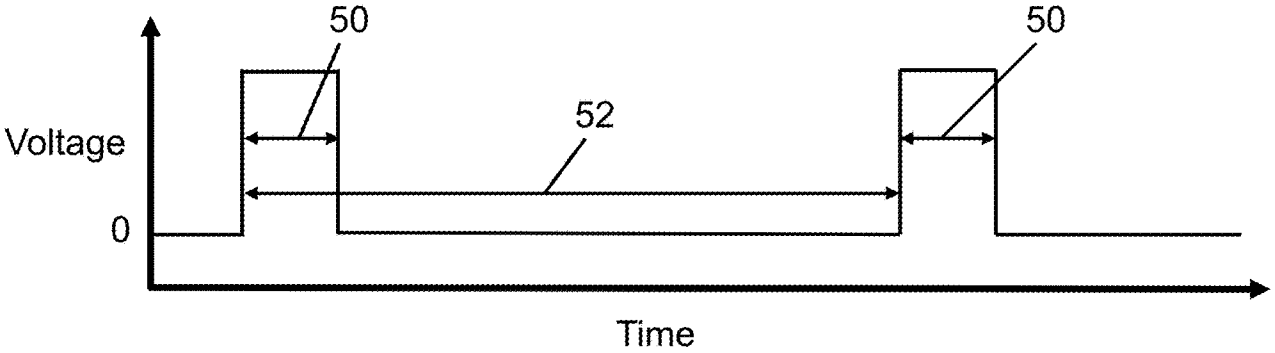
FIG. 3 is a graph showing a base drive time voltage supplied to an electric oil pump by an electronic control unit (ECU) of the present disclosure.

FIG. 3 illustrates an exemplary control signal supplied to the oil pump 18 by ECU 20. The signal from ECU 20 includes drive time or pump "ON" time portions 50 in which a voltage is supplied to the oil pump 18 to cause oil pump 18 to pump oil from oil tank 16 to the engine 12. FIG. 3 shows an example of a base drive time 50 or pump "ON" time for the oil pump 18. A cycle time for the oil pump 18 is equal to the time between successive drive pulses 50. Cycle time is illustrated by dimension 52 in FIG. 3. Cycle time 52 is adjustable to change a frequency of operation of the oil pump 18, thereby changing the volume of oil delivered over time.

Figure 4:
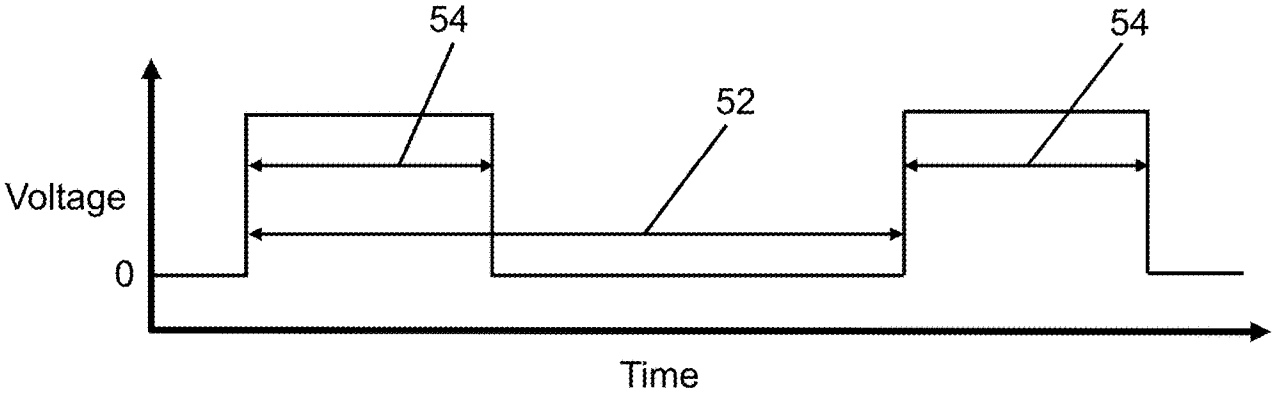
FIG. 4 is a graph showing an increased drive time voltage supplied to the electric oil pump by the ECU under cold temperature operating conditions.

In the system and method of the present disclosure, the drive time 50 and frequency or cycle time 52 are adjustable by the ECU 20 depending upon operating conditions of the engine as described below to control the oil pump 18. Specifically, the system and method of the present disclosure adjusts the drive time signal to oil pump 18 and provides cold temperature volume compensation. For example, FIG. 4 illustrates a modified drive time illustrated by dimension 54 which has been increased by the ECU 20. The cycle time 52 remains the same in the illustrated embodiment of FIG. 4.

Figure 5:
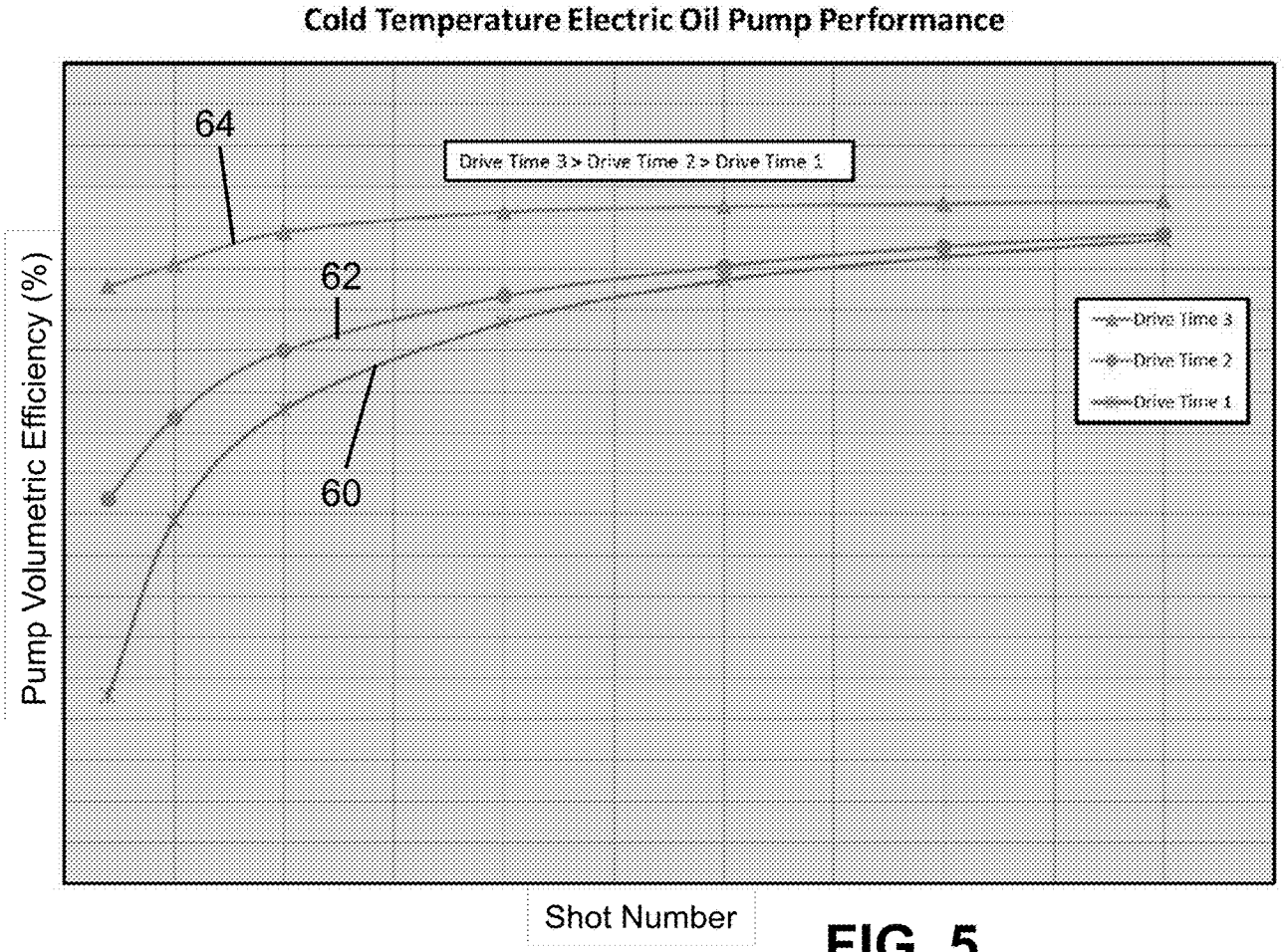
FIG. 5 is a graph showing volumetric efficiency of the electric oil pump during cold temperature performance at three different oil pump drive times.

As shown in FIG. 5, volumetric efficiency of oil pump 18 increases, especially during initial actuation of the oil pump 18 at cold temperatures with high oil viscosity as the drive time 54 of the control signal increases. FIG. 5 is a graph showing pump volumetric efficiency percentage for three different drive times 60, 62 and 64 supplied to the oil pump 18 by ECU 20. In the illustrated embodiment, drive time 62 is greater than drive time 60. Drive time 64 is greater than drive time 62. Therefore, the longer drive time 54 of the control signal, the more efficient the oil pump 18 operates, especially during initial shots of the oil pump 18 at cold temperatures.

Figure 6:
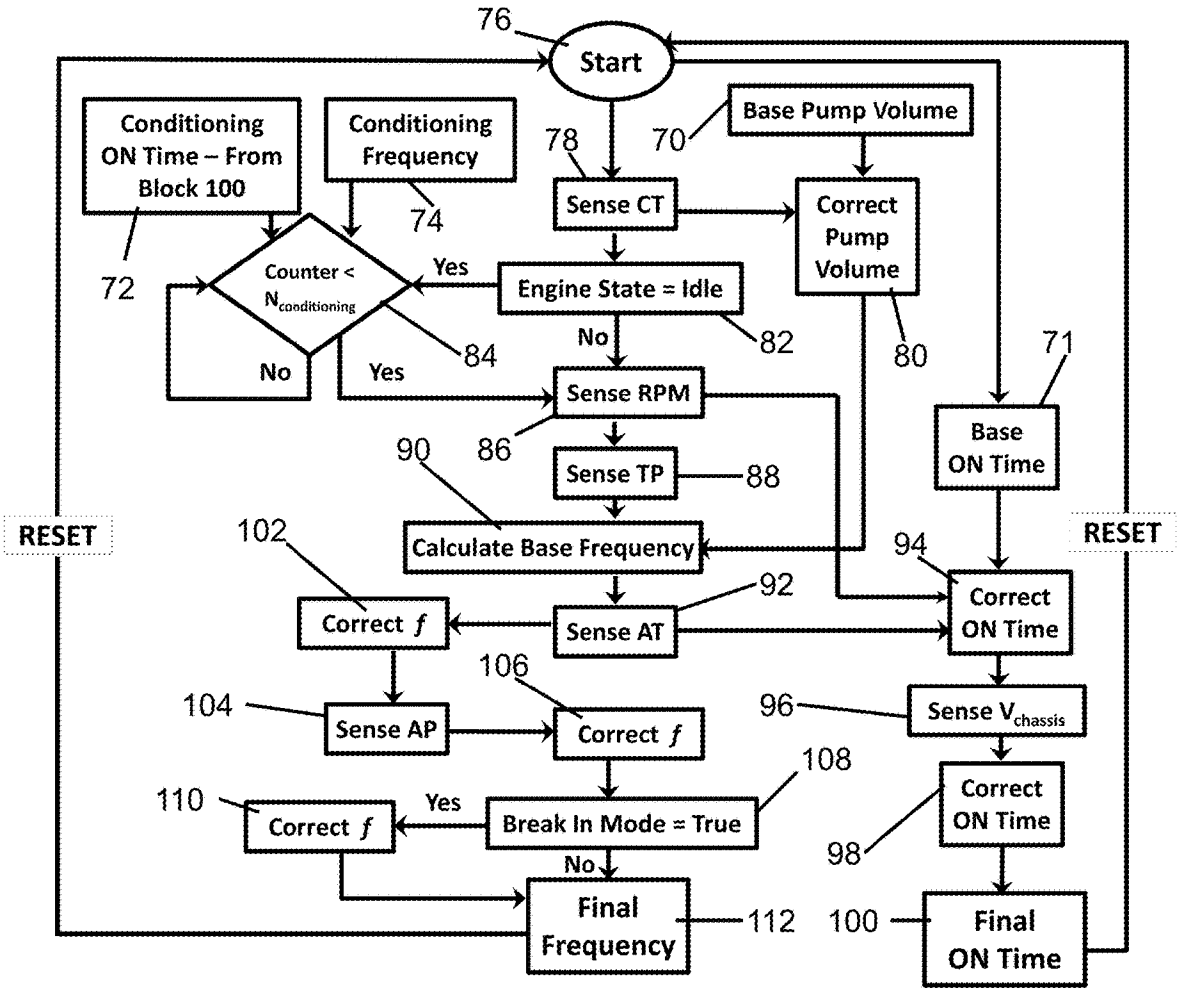
FIG. 6 is a flow chart illustrating control of the electric oil pump by the ECU.

One embodiment of operation of the lubrication system 10 and control method of the present disclosure is illustrated in FIG. 6. The ECU 20 uses a known base pump volume as illustrated at block 70 and a base drive time 50 for the oil pump 18 illustrated at block 71. The base pump volume 70 is a volume of oil typically pumped by oil pump 18 during each stroke or shot of the oil pump 18 at a normal engine operating temperature which is in the range of about 100-140° F. ECU 20 receives a characteristic pump volume input 38 which is a variable that defines the nominal or base volume of the pump. The base oil pump volume is illustratively determined by an actual measurement of oil pump volume during the manufacture of the oil pump. The oil pumps are sorted by the supplier according to volumetric flow rate. This flow rate represents the pump volume in volume per actuation and is identified as block 70 in FIG. 6.

The base drive time 50 is a length of time for a full stroke of a piston of the oil pump 18. The base pump volume at block 70 and base drive time at block 71 vary depending upon the particular characteristics of the oil pump 18.

The system and method of the present disclosure further include a conditioning drive time or pump "ON" time input parameter illustrated at block 72 and a conditioning frequency input parameter illustrated at block 74. The conditioning drive time at block 72 is illustratively longer than the base drive time at block 71. For example, drive time 50 of FIG. 3 illustratively represents the base drive time 71 while drive time 54 of FIG. 4 illustratively represents the conditioning drive time 72. Drive time during output conditioning at block 72 is taken from block 100 in FIG. 6 and incorporates corrections by air temperature, engine speed and chassis voltage as discussed herein. The conditioning frequency at block 74 is illustratively a fraction of a maximum operating frequency at cold temperatures established and recommended by pump suppliers, although other frequencies may be used. In an illustrative example, the conditioning frequency at block 74 may be set at about 1 Hz.

Operation of the system and method starts at block 76. ECU 20 senses coolant temperature from coolant temperature sensor 28 as illustrated at block 78. ECU 20 uses the coolant temperature to determine a corrected pump volume for oil pump 18 as illustrated at block 80. As discussed above, viscosity of the oil increases at cold temperatures thereby decreasing the efficiency of the oil pump 18. In an illustrated embodiment, ECU 20 uses a look up table to adjust the base pump volume 70 based upon the coolant temperature sensed at block 78. For example, as the coolant temperature decreases, the viscosity of the oil increases, thereby reducing the volume of oil pumped during each shot. Therefore, suitable correction is made at block 80 to account for the reduced oil volume from each shot of the oil pump 18.

ECU 20 detects whether the engine state is an idle condition using the idle state sensor 22 as illustrated at block 82. If the engine is idling at block 82, a counter is initiated at block 84 based on a predetermined number of conditioning shots (N) necessary to clear the ineffective first oil pump shots. If the counter value is less than the predetermined number of conditioning shots (N) at block 84, ECU 20 operates the oil pump 18 using the conditioning drive time 72 and conditioning frequency 74. The ECU 20 continues in a loop at block 84 until the number of oil pump actuations exceeds the predetermined number of conditioning shots (N). Therefore, the ECU 20 eliminates the first ineffective shots of oil pump 18 after start up. These first few shots from the oil pump 18 at cold temperature start up produce little or no flow volume as illustrated at location 40 in FIG. 2.

The variable (N) is illustratively determined using a calibratable one-dimensional table with the ordinates of engine temperature in which the values outline the number of shots which are actuated upon first entry into idle mode. The system operates on a decrementing counter at block 84 which is reset only on first start but is not reset after a PERC actuation. This characteristic "Dead Time/Count" is accommodated in the ECU control strategy at block 84 such that the ECU 20 commands a calibratable number of actuations (N) which are accepted to be of such a low volumetric efficiency that they are not factored into the total oil delivery requirements and, as such, are completed upon first start up. In one illustrated embodiments, a typical number (N) of ineffective oil pump shots is about 25. This strategy commands the shots on first entry into idle state such that once these shots are completed, the pump volumetric efficiency is increased via input control signal manipulation. These first actuations are not factored into total oil delivery requirements of the engine as it is assumed that the pump will operate at negligible volumetric efficiency.

If the counter value at block 84 is greater than the predetermined number of conditioning shots (N), ECU 20 senses a speed of the engine 12 from engine speed sensor 26 as illustrated at block 86. Next, ECU 20 senses a throttle position from throttle position sensor 30 as illustrated at block 88. ECU 20 then calculates a base frequency for the oil pump 18 as illustrated at block 90 using the engine speed and throttle position as well as the corrected pump volume at block 80. ECU 20 uses the engine speed and throttle position to determine the necessary amount of oil to be delivered to engine 12 to provide the proper fuel/oil ratio in two stroke engines, for example. Once this desired volume is known, ECU 20 used the corrected pump volume 80 which provides an actual amount of oil delivered by the oil pump 18 to calculate the base frequency at block 90.

Next, ECU 20 senses air temperature from air temperature sensor 24 at block 92. The air temperature sensed at block 92 is used to correct both the drive time or pump "ON" time of oil pump 18 at block 94 and to correct the frequency (cycle time) of the oil pump control signal at block 102. In other words, referring to FIG. 3, the sensed air temperature is used to correct the length of the drive time portion 50 of the control signal for oil pump 18. The engine speed sensed at block 86 is also used to correct the drive time 50 of the control signal from ECU 20.

In addition, the frequency or cycle time 52 of the oil pump signal is also corrected using the sensed air temperature as illustrated at block 102. Again, when air temperature is low and oil viscosity is high, a higher frequency control signal is needed to supply the desired volume of oil to the engine.

Once the drive time is corrected using the sensed air temperature and engine speed at block 94, the ECU determines a chassis voltage from chassis voltage sensor 32 as illustrated at block 96. Typically, a chassis voltage remains at a constant voltage unless a problem exists, such as with a voltage regulation system. If necessary, ECU 20 then corrects the drive time of the oil pump 18 control signal based on the sensed chassis voltage as illustrated at block 98 to provide the final drive time or pump "ON" time for driving the oil pump 18 as illustrated at block 100. A one dimensional table is illustratively used to adjust the drive time at block 98 based on changes in the chassis voltage. As the chassis voltage decreases, the drive time increases to keep the force and the power consumed constant.

ECU 20 determines an air pressure from air pressure sensor 34 as illustrated at block 104. The frequency of the oil pump control signal is adjusted based on the sensed air pressure as illustrated at block 106. For example, at high altitudes and low pressure, the frequency of the drive signal is decreased since less oil is required at high altitudes with lower fuel flow rates. If the air pressure is high, such as at low altitudes, then the frequency is increased at block 106.

Next, ECU 20 determines whether the engine 12 is in a break-in mode using break-in information 36. If the engine 12 is in break-in mode, ECU 20 again corrects the frequency of the oil pump control signal as illustrated at block 110. For example, the frequency is adjusted to increase the amount of oil delivered by oil pump 18 by about 10-20 percent when the engine 12 is in break-in mode. In the illustrated embodiment, the break-in mode information 36 is determined by the total amount of time that the engine has been operated regardless of engine speed. If the engine has been operated less than a predetermined amount of time, then the engine is considered to be in break-in mode. It is understood that other factors may be used to determine when the engine is in a break-in mode.

If the engine is in break-in mode at block 108, the corrected frequency at block 110 is used for the final frequency of the oil pump control signal as illustrated at block 112. If the engine is not in break-in mode at block 108, the corrected frequency from block 106 is used as the final frequency at block 112.

The final frequency at block 112 and final drive time at block 110 are used by ECU 20 to generate the control signal for the oil pump 18 such as by setting the drive time 54 and cycle time 52 in FIG. 4 for example. The frequency and drive times are then reset and ECU 20 returns to block 76 to start the process again. Therefore, the system and method of the present disclosure continuously calculates the drive time, corrected pump volume and frequency of the control signal for the electric oil pump 18.

In one embodiment, the control system and method of FIG. 6 is used from start up until the engine temperature reaches a predetermined temperature such as about 100° F. to 140° F. Once the engine approaches its normal operating range, the volumetric correction is reduced until the pump is operating normally. The base pump volume 70 and base pump drive time 71 are then used by ECU 20 to drive the electric oil pump 18.

The system and method of the present diclosure controls operation of the electric oil pump 18 without the need to monitor a stroke position of a piston of the oil pump 18 to provide feedback to the ECU 20. Instead, the system and method of the present disclosure uses information on the flow characteristics of different oils with a characteristic pump volume of the electric oil pump 18 adjusted for varying temperatures and frequencies. The system and method of the present disclosure accommodates the reduction in oil pump volumetric efficiency as a function of increased oil viscosity and manipulates commanded signal to provide increased pump output at critical cold temperatures and low drive frequencies. The system and method of the present disclosure conditions an electric oil pump output rather than manipulating a pump command signal in an attempt to warm the pump to increase efficiency.

Drive time manipulation alone does not guarantee pump volumetric efficiency. Instead of compromising the fuel oil ratios to provide adequate oil deliver at cold temperatures which may over oil at warm temperatures, the present system and method uses volume manipulation by ambient air temperature to accommodate the reduction in pump volumetric efficiency without requiring manipulation of target fuel/oil ratio. The combination of drive time manipulation and volume compensation allows both increased performance and compensation for the pump volumetric efficiency as a function of temperature while maintaining consistent fuel/oil ratio targets.

While embodiments of the present disclosure have been described as having exemplary designs, the present invention may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this invention pertains.

The invention claimed is:

1. A method of controlling an electric oil pump with a pump control signal generated by an electronic control unit (ECU) of a vehicle, the pump control signal having a variable drive time portion during which the electric oil pump is actuated to supply oil to an engine of the vehicle and a variable cycle time defining a frequency of the pump control signal, the method comprising:

determining a base pump volume of the electric oil pump;

determining a temperature associated with the engine;

determining a corrected pump volume by correcting the base pump volume using the determined temperature;

determining a speed of the engine;

determining a frequency of the pump control signal based on the determined engine speed and the corrected pump volume;

determining a drive time of the pump control signal based on both the determined engine speed and the determined temperature; and controlling the electric oil pump using the pump control signal having the determined drive time and the determined frequency.

2. The method of claim 1, further comprising:

sensing that the engine is in an idle state upon initial start up of the engine;

determining a number of initial ineffective oil pump actuations due to a high oil viscosity based on the determined temperature; and operating the electric oil pump with a pump control signal from the ECU having a conditioning drive time and conditioning frequency for the determined number of initial ineffective oil pump actuations.

3. The method of claim 2, wherein the conditioning drive time is longer than a base drive time required for a full stoke of a piston of the electric oil pump.

4. The method of claim 1, further comprising determining a throttle position of a throttle of the engine, wherein the step of determining the frequency of the pump control signal is also based on the determined throttle position.

5. The method of claim 1, wherein the step of determining a temperature associated with the engine includes sensing a temperature of a coolant fluid of the engine.

6. The method of claim 5, further comprising sensing an air temperature at an air intake portion of the engine and correcting the determined frequency of the pump control signal and the determined drive time of the pump control signal based on the sensed air temperature.

7. The method of claim 1, wherein the step of determining a temperature associated with the engine includes sensing an air intake portion of the engine.

8. The method of claim 1, further comprising sensing an air pressure adjacent the engine of the vehicle and correcting the determined frequency of the pump control signal based on the sensed air pressure.

9. The method of claim 1, further comprising determining whether the engine is in a break-in mode and correcting the determined frequency of the pump control signal if the engine is in a break-in mode.

10. The method of claim 9, wherein the corrected frequency of the pump control signal increases oil flow to the engine by about 10-15% when the engine is in a break-in mode.

11. The method of claim 9, wherein the break-in mode is determined based on a total operating time of the engine.

12. The method of claim 1, further comprising sensing a voltage of a chassis of the vehicle and correcting the determined drive time of the pump control signal based on the sensed chassis voltage.

13. The method of claim 1, wherein the electric oil pump is mounted to a vehicle chassis spaced apart from the engine.

14. A method of controlling an electric oil pump with a pump control signal generated by an electronic control unit (ECU) of a vehicle, the pump control signal having a variable drive time portion during which the electric oil pump is actuated to supply oil to an engine of the vehicle and a variable cycle time defining a frequency of the pump control signal, the method comprising:

determining a speed of the engine;

determining a temperature associated with the engine;

determining a number of initial ineffective oil pump actuations after start up of the engine due to a high oil viscosity based on the determined temperature;

determining a volume of oil to deliver from the electric oil pump to the engine independent of the determined number of initial ineffective oil pump actuations;

determining a frequency of the pump control signal and a drive time of the pump control signal based on both the determined temperature and determined engine speed to deliver the determined volume of oil from the electric oil pump to the engine; and controlling the electric oil pump using the pump control signal having the determined drive time and the determined frequency.

15. The method of claim 14, wherein the plurality of initial oil pump actuations is less than 25 oil pump actuations.

16. The method of claim 14, further comprising sensing that the engine is in an idle state upon initial start up of the engine, and ignoring the determined number of initial ineffective oil pump actuations if the engine is in an idle state upon initial start up of the engine.

17. The method of claim 14, further comprising:

determining a base pump volume of the electric oil pump; and correcting the base pump volume using the determined temperature to provide a corrected pump volume, wherein determining the frequency of the pump control signal is based on the determined engine speed and the corrected pump volume.

18. The method of claim 17, further comprising determining a throttle position of a throttle of the engine, wherein the step of determining the frequency of the pump control signal is also based on the determined throttle position.

19. The method of claim 14, wherein the step of determining a temperature associated with the engine includes sensing a temperature of a coolant fluid of the engine.

20. The method of claim 14, further comprising sensing an air temperature at an air intake portion of the engine and correcting the determined frequency of the pump control signal and the determined drive time of the pump control signal based on the sensed air temperature.

21. The method of claim 14, wherein the step of determining a temperature associated with the engine includes sensing an air intake portion of the engine.

22. The method of claim 14, further comprising sensing an air pressure adjacent the engine of the vehicle and correcting the determined frequency of the pump control signal based on the sensed air pressure.

23. The method of claim 14, further comprising sensing a voltage of a chassis of the vehicle and correcting the determined drive time of the pump control signal based on the sensed chassis voltage.

24. A method of controlling an electric oil pump with a pump control signal generated by an electronic control unit (ECU) of a vehicle, the pump control signal having a variable drive time portion during which the electric oil pump is actuated to supply oil to an engine of the vehicle and a variable cycle time defining a frequency of the pump control signal, the method comprising:

determining a base pump volume of the electric oil pump;

determining a temperature associated with the engine;

determining a corrected pump volume by correcting the base pump volume using the determined temperature;

determining a speed of the engine;

determining a frequency of the pump control signal based on the determined engine speed and the corrected pump volume;

determining a base drive time of the pump control signal;

sensing a voltage of a chassis of the vehicle and correcting the base drive time of the pump control signal based on the sensed chassis voltage; and controlling the electric oil pump using the pump control signal having the determined frequency and the corrected drive time.

25. The method of claim 24, further comprising determining a throttle position of a throttle of the engine, wherein the step of determining the frequency of the pump control signal is also based on the determined throttle position.

26. The method of claim 24, further comprising sensing an air temperature at an air intake portion of the engine and correcting the determined frequency of the pump control signal based on the sensed air temperature.

27. The method of claim 24, further comprising sensing an air pressure adjacent the engine of the vehicle and correcting the determined frequency of the pump control signal based on the sensed air pressure.

28. The method of claim 24, further comprising determining whether the engine is in a break-in mode and correcting the determined frequency of the pump control signal if the engine is in a break-in mode.

* * * * *